US010252527B2

(12) United States Patent
Feinn et al.

(10) Patent No.: US 10,252,527 B2
(45) **Date of Patent: *Apr. 9, 2019**

(54) NONCIRCULAR INKJET NOZZLE

(71) Applicant: HEWLETT-PACKARD DEVELOPMENT COMPANY, L.P., Houston, TX (US)

(72) Inventors: James A. Feinn, San Diego, CA (US); David P. Markel, Albany, OR (US); Albert Nagao, Corvallis, OR (US); Thomas R. Strand, Corvallis, OR (US); Paul A. Richards, Corvallis, OR (US); Lawrence H. White, Corvallis, OR (US); Erik D. Torniainen, Maple, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/834,353

(22) Filed: Dec. 7, 2017

(65) Prior Publication Data

US 2018/0104953 A1 Apr. 19, 2018

Related U.S. Application Data

(63) Continuation of application No. 13/634,753, filed as application No. PCT/US2011/021923 on Jan. 20, 2011.

(30) Foreign Application Priority Data

Mar. 31, 2010 (WO) ..... PCT/US2010/029450

(51) Int. Cl.
*B41J 2/14* (2006.01)

(52) U.S. Cl.
CPC ..... *B41J 2/1433* (2013.01); *B41J 2/14016* (2013.01); *B41J 2002/14387* (2013.01); *B41J 2002/14475* (2013.01); *B41J 2202/11* (2013.01)

(58) Field of Classification Search
CPC ..... B41J 2/1433; B41J 2/14016; B41J 2002/14387; B41J 2002/14475; B41J 2202/11
(Continued)

(56) References Cited

U.S. PATENT DOCUMENTS 6,123,413 A 9/2000 Agarwal et al.
6,203,145 B1 3/2001 Jeanmaire et al.
(Continued)

FOREIGN PATENT DOCUMENTS

CN 1191807 9/1998
CN 1236923 C 1/2006
(Continued)

OTHER PUBLICATIONS

Daniel Zwillinger; CRC Standard Mathematical Tables and Formulae, 30th Edition; CRC Press 1995 (2 pages).
(Continued)

*Primary Examiner* — Huan H Tran
*Assistant Examiner* — Alexander D Shenderov
(74) *Attorney, Agent, or Firm* — HP Inc. Patent Department

(57) ABSTRACT

In some examples, a fluid nozzle includes an aperture comprising a first lobe that is shaped as an ellipse, and a second lobe that has a non-circular shape and has a different size than a size of the first lobe. The fluid nozzle further includes protrusions between the first and second lobes extending inward and forming a throat between the first and second lobes.

16 Claims, 10 Drawing Sheets

(58) Field of Classification Search
USPC ..... 347/47, 61
See application file for complete search history.

(56) References Cited

U.S. PATENT DOCUMENTS

| | | | | |
|---|---|---|---|---|
| 6,254,219 | B1 | 7/2001 | Agarwal et al. | |
| 6,371,596 | B1 | 4/2002 | Maze | |
| 6,527,369 | B1 * | 3/2003 | Weber | B41J 2/14 347/45 |
| 6,557,974 | B1 | 5/2003 | Weber | |
| 6,666,550 | B2 | 12/2003 | Sasaki | |
| 6,860,588 | B1 | 3/2005 | Holstun et al. | |
| 7,506,962 | B2 | 3/2009 | Murakami | |
| 7,967,413 | B2 | 6/2011 | Koizumi | |
| 2004/0051757 | A1 | 3/2004 | Holland | |
| 2004/0155928 | A1 | 8/2004 | Clark et al. | |
| 2007/0081034 | A1 * | 4/2007 | Worsman | B41J 2/1404 347/56 |
| 2007/0146437 | A1 | 6/2007 | Murakami et al. | |
| 2008/0106574 | A1 | 5/2008 | Imahashi et al. | |
| 2008/0291245 | A1 | 11/2008 | Takei | |
| 2009/0002447 | A1 | 1/2009 | Takei et al. | |
| 2009/0147056 | A1 | 6/2009 | Oikawa et al. | |
| 2011/0041335 | A1 | 2/2011 | Xie | |

FOREIGN PATENT DOCUMENTS

| | | | |
|---|---|---|---|
| CN | 101310983 | A | 11/2008 |
| CN | 101316712 | | 12/2008 |
| EP | 0792744 | | 9/1997 |
| JP | 09131877 | | 5/1997 |
| JP | 09239986 | | 9/1997 |
| KR | 2008-0080589 | | 9/2008 |
| WO | WO-2009082391 | | 7/2009 |
| WO | WO-2011123120 | A1 | 10/2011 |

OTHER PUBLICATIONS

International Search Report for Application No. PCT/US2011/021923; Report dated Dec. 12, 2012 (11 pages).
International Search Report, PCT/US2010/029450, Filed Mar. 31, 2010, Report dated Jan. 19, 2011 (6 pages).
Liu, J., Spiegel, M.R. Mathematical handbook of formulas and tables,2 nd ed., McGraw-Hili, 1999, p. 29.

* cited by examiner

| | |
|---|---|
| A | 12.3000 |
| B | 12.3096 |
| C | 0.0593 |
| C | 1.5170 |

| | |
|---|---|
| A | 12.3000 |
| B | 12.3096 |
| C | 0.0593 |
| C | 1.5170 |

| | |
|---|---|
| A | 12.3000 |
| B | 12.3096 |
| C | 0.0593 |
| C | 1.5170 |

| | |
|---|---|
| A | 12.3000 |
| B | 12.3096 |
| C | 0.0593 |
| C | 1.5170 |

| | |
|---|---|
| A | 12.3000 |
| B | 12.3096 |
| C | 0.0593 |
| C | 1.5170 |

| | |
|---|---|
| A | 12.3000 |
| B | 12.3096 |
| C | 0.0593 |
| C | 1.5170 |

| | |
|---|---|
| A | 12.3000 |
| B | 12.3096 |
| C | 0.0593 |
| C | 1.5170 |

| | |
|---|---|
| A | 12.3000 |
| B | 12.3152 |
| C | 0.0935 |
| C | 1.5183 |

| | |
|---|---|
| A | 12.3000 |
| B | 12.3096 |
| C | 0.0593 |
| C | 1.5170 |

| | |
|---|---|
| A | 12.3000 |
| B | 12.3283 |
| C | 0.1724 |
| C | 1.5214 |

| | |
|---|---|
| A | 12.3000 |
| B | 12.3678 |
| C | 0.4179 |
| C | 1.5311 |

| | |
|---|---|
| A | 12.3000 |
| B | 12.3283 |
| C | 0.1724 |
| C | 1.5214 |

| | |
|---|---|
| A | 12.3000 |
| B | 12.3096 |
| C | 0.0593 |
| C | 1.5170 |

| | |
|---|---|
| A | 12.3000 |
| B | 12.3152 |
| C | 0.0935 |
| C | 1.5183 |

| | |
|---|---|
| A | 12.3000 |
| B | 12.3096 |
| C | 0.0593 |
| C | 1.5170 |

| | |
|---|---|
| A | 12.3000 |
| B | 12.3152 |
| C | 0.0935 |
| C | 1.5183 |

NONCIRCULAR INKJET NOZZLE

CROSS REFERENCE TO RELATED APPLICATIONS

This is a continuation of U.S. application Ser. No. 13/634,753, having a national entry date of Sep. 13, 2012, which is a national stage application under 35 U.S.C. § 371 of PCT/US2011/021923, filed Jan. 20, 2011, which claims priority to International Application No. PCT/US2010/029450, filed on Mar. 31, 2010, which are all hereby incorporated by reference in their entirety.

BACKGROUND

Inkjet technology is widely used for precisely and rapidly dispensing small quantities of fluid. Inkjets eject droplets of fluid out of a nozzle by creating a short pulse of high pressure within a firing chamber. During printing, this ejection process can repeat thousands of times per second. Ideally, each ejection would result in a single ink droplet which travels along a predetermined velocity vector for deposition on the substrate. However, the ejection process may create a number of very small droplets which remain airborne for extended periods of time and are not deposited at the desired location on the substrate.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1C:
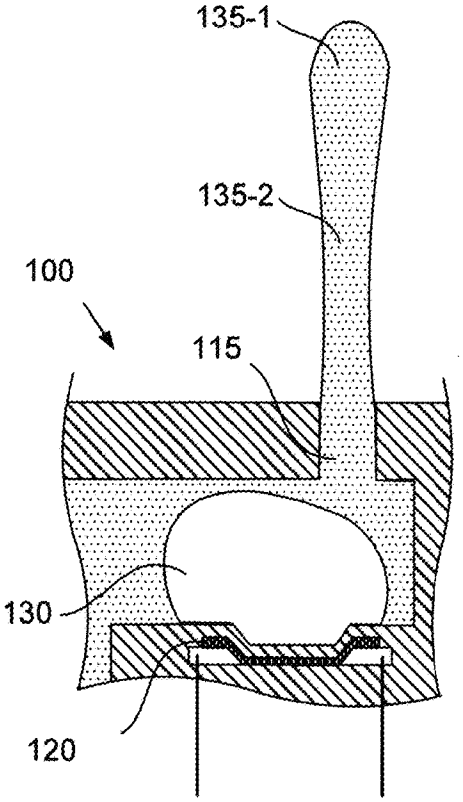
FIGS. 1A-1F are illustrative diagrams of the operation of a thermal inkjet droplet generator, according to an embodiment of principles described herein.

As discussed above, the inkjet printing process deposits fluids on a substrate by ejecting fluid droplets from a nozzle.

Typically, the inkjet device contains a large array of nozzles which eject thousands of droplets per second during printing. For example, in a thermal inkjet, the printhead includes an array of droplet generators connected to one or more fluid reservoirs. Each of the droplet generators includes an ejection element, a firing chamber and a nozzle. The ejection element may take the form of a heating element, a piezoelectric actuator, or any of a variety of other structures configured to eject droplets of fluid through a nozzle. Once fluid is ejected from the ejection element, fluid from the reservoir refills the firing chamber, and the ejection element is again ready to eject a droplet through the nozzle.

Where the ejection element takes the form of a heating element placed adjacent to the firing chamber, fluid ejection may be effected by passing an electrical current through the heating element. The heating element generates heat that vaporizes a small portion of the fluid within the firing chamber. The vapor rapidly expands, forcing a small droplet out of the firing chamber nozzle. The electrical current is then turned off and the heating element cools. The vapor bubble rapidly collapses, drawing more fluid into the firing chamber from a reservoir.

Ideally, each firing event would result in a single droplet which travels along a predetermined vector at a predetermined velocity and is deposited in the desired location on the substrate. However, due to the forces which are applied to the fluid as it is ejected and travels through the air, the initial droplet may be torn apart into a number of sub-droplets. Very small sub-droplets may lose velocity quickly and remain airborne for extended periods of time. These very small sub-droplets can create a variety of problems. For example, the sub-droplets may be deposited on the substrate in incorrect locations which may lower the printing quality of the images produced by the printer. The sub-droplets may also be deposited on printing equipment, causing sludge build up, performance degradation, reliability issues, and increasing maintenance costs.

One approach which can be used to minimize the effects of airborne sub-droplets is to capture and contain them. A variety of methods can be used to capture the sub-droplets. For example, the air within the printer can be cycled through a filter which removes the airborne sub-droplets. Additionally or alternatively, electrostatic forces can be used to attract and capture the sub-droplets. However, each of these approaches requires additional equipment to be integrated into the printer. This can result in a printer which is larger, more expensive, consumes more energy, and/or is more maintenance intensive.

An alternative approach is to design the droplet generator to minimize velocity differences which tend to tear apart the ejected droplet. This may directly reduce the formation of the airborne sub-droplets. The shape of the inkjet nozzle can be altered to reduce the velocity differences which have a tendency to tear apart a droplet during ejection. Specifically, inkjet nozzles which have a smooth profile with one or more protrusions into the center of the nozzle aperture reduce velocity differences within the ejected droplet and leverage viscous forces to prevent the droplet from being torn apart.

In the following description, for purposes of explanation, numerous specific details are set forth in order to provide a thorough understanding of the present systems and methods. The present apparatus, systems and methods, however, may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in an embodiment", "in one embodiment" or similar phrases in various places in the specification are not necessarily all referring to the same embodiment.

Figure 1B:
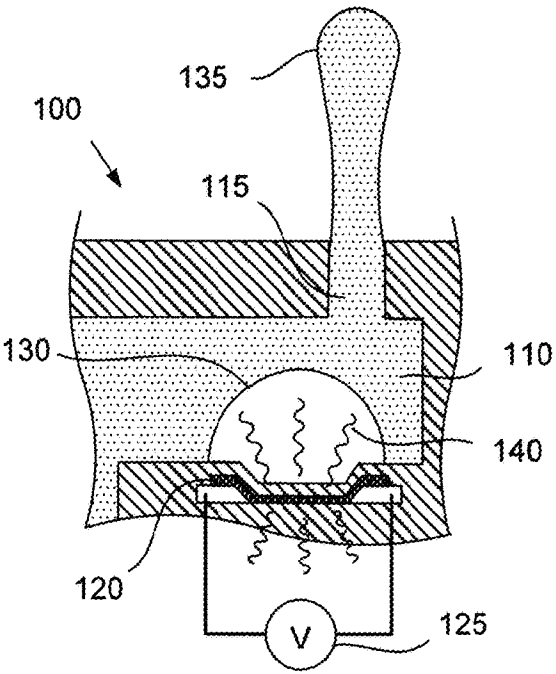
Figure 1A:
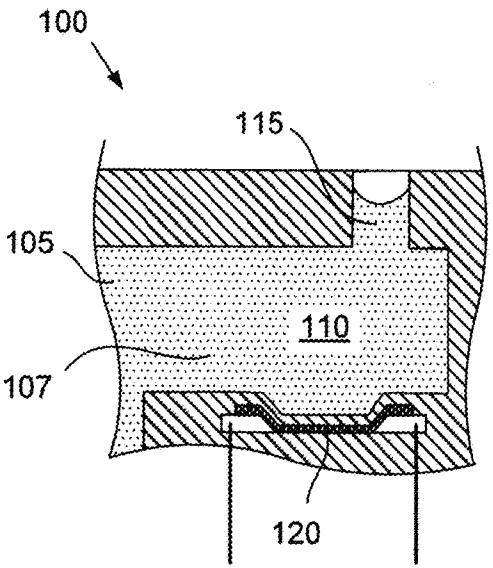

FIGS. 1A-1F show an illustrative time sequence of a droplet being ejected from the thermal inkjet droplet generator. FIG. 1A is a cross-sectional view of an illustrative droplet generator (100) within a thermal inkjet printhead. The droplet generator (100) includes a firing chamber (110) which is fluidically connected to a fluid reservoir or fluid slot (105). A heating element (120) is located in proximity to the firing chamber (110). Fluid (107) enters the firing chamber (110) from the fluid reservoir (105). Under isostatic conditions, the fluid does not exit the nozzle (115), but forms a concave meniscus within the nozzle exit.

FIG. 1B is a cross-sectional view of a droplet generator (100) ejecting a droplet (135) from the firing chamber (110). Droplet (135) of fluid may be ejected from the firing chamber (110) by applying a voltage (125) to the heating element (120). The heating element (120) can be a resistive material which rapidly heats due to its internal resistance to electrical current. Part of the heat generated by the heating element (120) passes through the wall of the firing chamber (110) and vaporizes a small portion of the fluid immediately adjacent to the heating element (120). The vaporization of the fluid creates a rapidly expanding vapor bubble (130) which overcomes the capillary forces retaining the fluid within the firing chamber (110) and nozzle (115). As the vapor continues to expand, a droplet (135) is ejected from the nozzle (115).

In FIG. 1C, the voltage is removed from the heating element (120), which rapidly cools. The vapor bubble (130) continues to expand because of inertial effects. Under the combined influence of rapid heat loss and continued expansion, the pressure inside the vapor bubble (130) drops rapidly. At its maximum size, the vapor bubble (130) may have a relatively large negative internal pressure. The droplet (135) continues to be forced from the firing chamber and forms a droplet head (135-1) which has a relatively high velocity and a droplet tail (135-2) which may have a lower velocity.

Figures 1D, 1E, 1F:
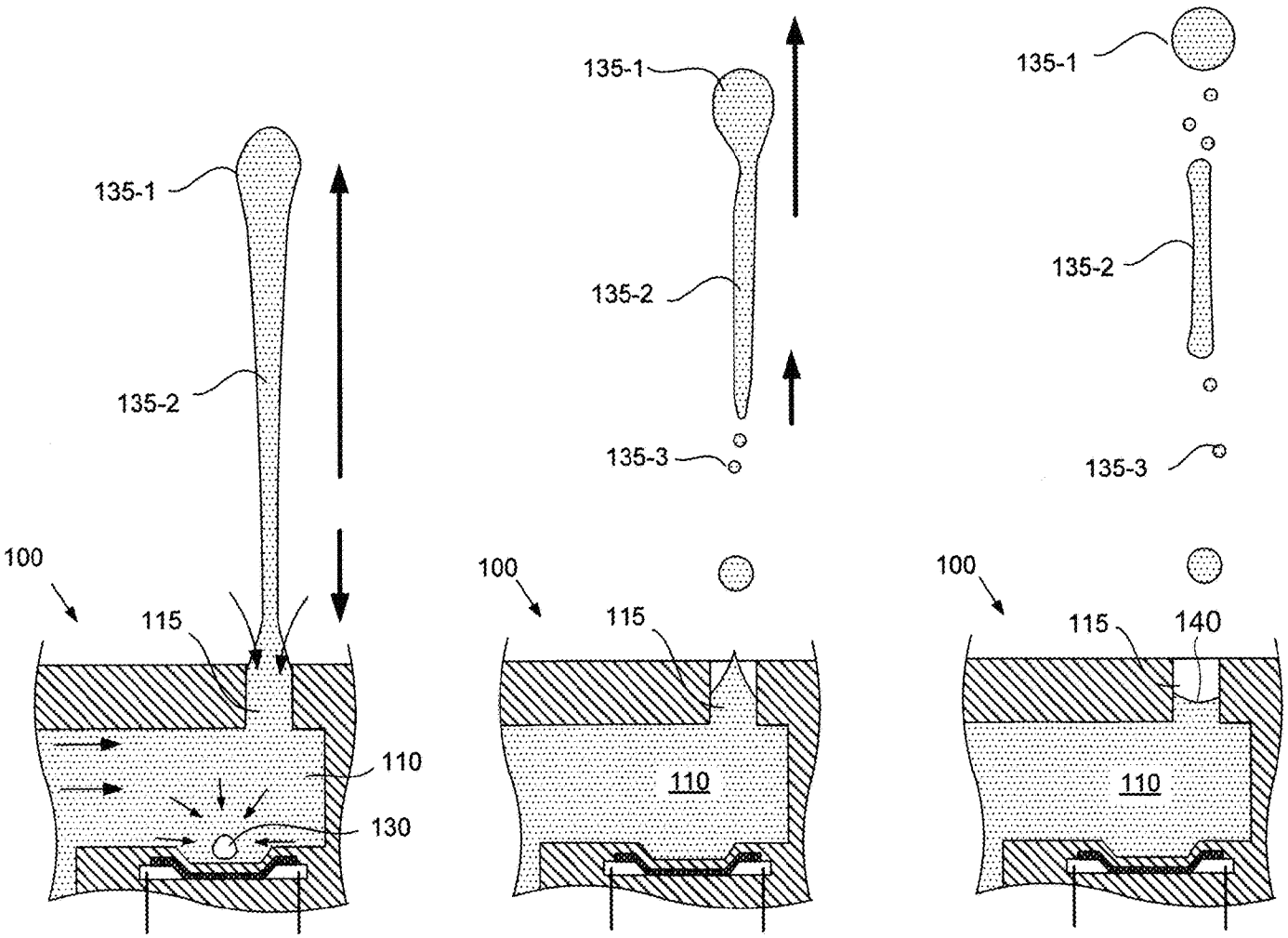

FIG. 1D shows the rapid collapse of the vapor bubble (130). This rapid collapse may result in a low pressure in the firing chamber (110), which draws liquid into the firing chamber (110) from both the inlet port and the nozzle (115). This sudden reversal of pressure sucks a portion of the droplet tail (135-2) which has most recently emerged from the nozzle (115) back into the nozzle (115). Additionally, overall velocity of the droplet tail (135-2) may be reduced as viscous attraction within the droplet tail resists the separation of the droplet (135). During this stage, the low pressure in the firing chamber (110) also tends to draw outside air into the nozzle (115). The dark arrows to the right of the droplet (135) illustrate relative velocities of portions of the droplet during the bubble (130) collapse. The gap between the arrows indicates a stagnation point where the velocity of the droplet tail (135-2) is zero.

FIG. 1E shows the droplet (135) snapping apart at or near the stagnation point. In the illustrative example, the violence of the breakup of the droplet tail (135-2) creates a number of sub-droplets or satellite droplets (135-3). These sub-droplets (135-3) have relatively low mass and may have very low velocity. Even if the sub-droplets (135-3) have some velocity, it can be lost relatively rapidly as the low mass sub-droplets (135-3) interact with the surrounding air. Consequently, the sub-droplets (135-3) may remain airborne for an extended period of time. As discussed above, the sub-droplets (135-3) may drift relatively long distances before contacting and adhering to a surface. If the sub-droplets (135-3) adhere to the target substrate, they typically cause print defects as they land outside of the target area. If the sub-droplets (135-3) land on printing equipment, they can create deposits which compromise the operation of the printing device and create maintenance issues.

The differences in velocities between the droplet tail (135-2) and the droplet head (135-1) can also cause separation and the generation of sub-droplets. As shown in FIG. 1E, the relatively large droplet head (135-1) has a higher velocity (as shown by the dark arrow to the right of the droplet head) than the droplet tail (135-2) (as shown by the shorter arrow to the right of the droplet tail). This can cause the droplet head (135-1) to pull away from the droplet tail (135-2).

FIG. 1F shows the separation of the droplet head (135-1) from the droplet tail (135-2) as a result of the velocity differences between the droplet head (135-1) and the droplet tail (135-2). This may create additional sub-droplets (135-3).

It has been discovered that the velocity differences which tend to shatter the droplets during ejection from an inkjet printhead can be reduced by altering the shape of the inkjet nozzle. Traditionally, the apertures of inkjet nozzles are circular. These circular nozzles are easy to manufacture and have a high resistance to clogging. However, droplets ejected from circular nozzles tend to have velocity differences which may tear apart the droplets during ejection. Specifically, the violent retraction of the tail of the droplet during the bubble collapse can shatter the trailing portion of the tail and the velocity differences between the head of the droplet and the leading portion of the tail can cause separation of the head and the tail. These shatter events may produce small sub-droplets which can lead to the reliability issues described above.

Figure 2:
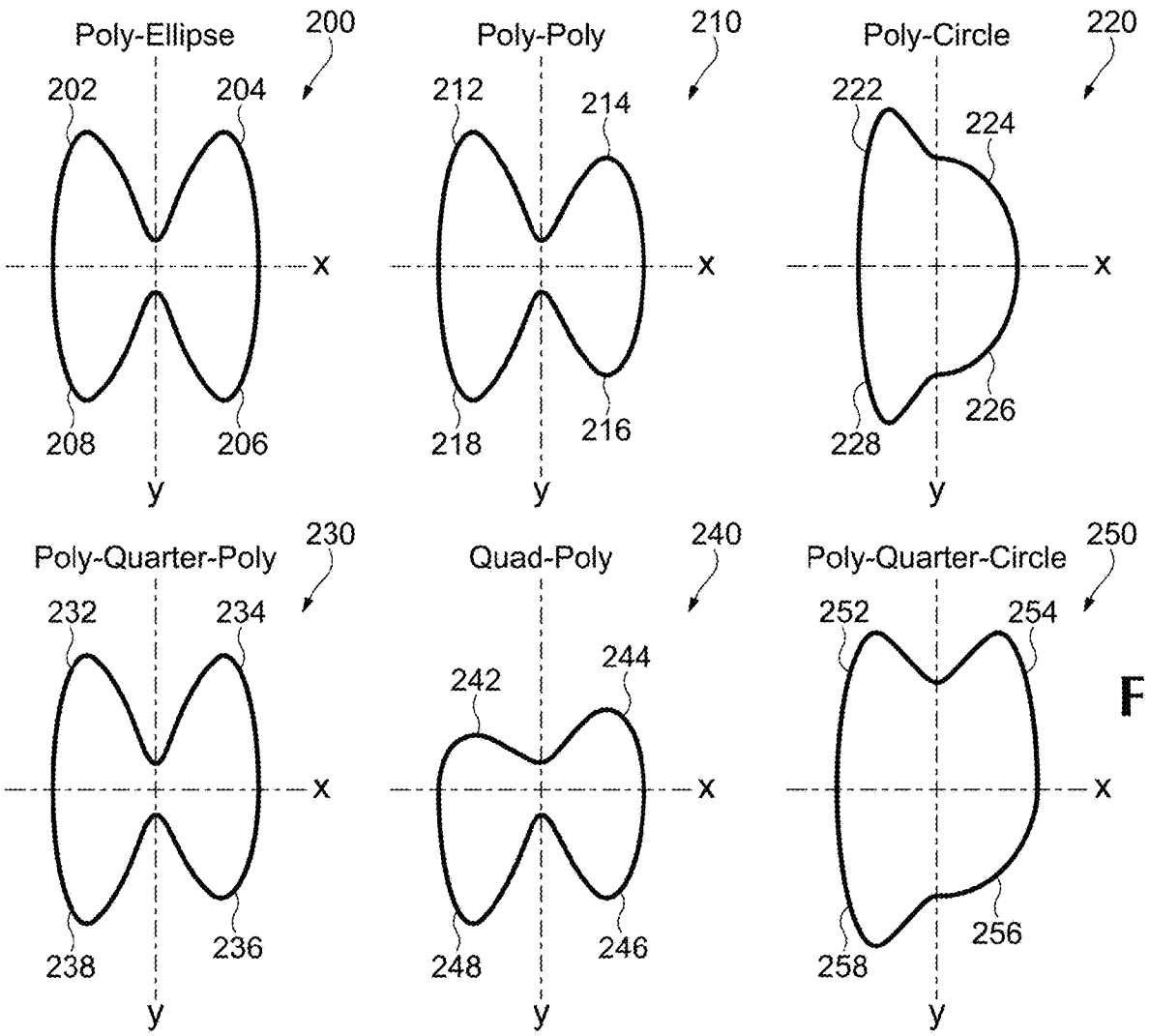
FIG. 2 is a diagram of illustrative noncircular nozzle geometries, according to embodiments of principles described herein.

By using a non-circular shape for the inkjet nozzles, these velocity differences can be reduced. FIG. 2 depicts six noncircular nozzle aperture geometries, each superimposed on a graph showing x and y distances in microns. The six shapes are: poly-ellipse (200), poly-poly (210), poly-circle (220), poly-quarter-poly (230), quad-poly (240), and poly-quarter-circle (250).

As indicated, each shape is defined by a perimeter that may be divided into four quadrants bounded by four distinct segments of an aperture. The poly-ellipse shape (200), for example, includes an upper-left quadrant bounded by a first segment (202), a upper-right quadrant bounded by a second segment (204), a lower-right quadrant bounded by a third segment (206) and a lower-left quadrant bounded by a fourth segment (208). For the poly-ellipse shape (200), each of the four segments is defined by a fourth degree polynomial equation: $(DX^2+CY^2+A^2)^2 - 4A^2X^2=B^4$, where A, B, C and D are constants. Each segment is defined using the same set of constants (A, B, C and D). The poly-ellipse shape (200) thus is symmetrical about both the x- and y-axes.

The poly-poly shape (210) includes an upper-left quadrant bounded by a first segment (212), an upper-right quadrant bounded by a second segment (214), a lower-right quadrant bounded by a third segment (216) and a lower-left quadrant bounded by a fourth segment (218), where each of the four segments is defined by a fourth degree polynomial equation of the general form: $(DX^2+CY^2+A^2)^2 - 4A^2X^2=B^4$. However, unlike the poly-ellipse shape (which is symmetric about the x- and y-axes), the poly-poly shape (210) is asymmetric about at least one of the x- and y-axes. In particular, poly-poly shape (210) includes a first segment (212) defined using a first set of constants $A_1$, $B_1$, $C_1$ and $D_1$, and a second segment (214) defined using a second set of constants $A_2$, $B_2$, $C_2$ and $D_2$, different than the first set of constants. Poly-poly shape (210) includes a third segment (216) defined using the second set of constants A2, 82, C2 and O2, and includes a fourth segment (218) defined by the first set of constants A1, 81, C1 and O1. Poly-poly shape (210) thus is asymmetric about the y-axis, and is symmetric about the x-axis.

The poly-circle shape (220) includes an upper-left quadrant bounded by a first segment (222), an upper-right quadrant bounded by a second segment (224), a lower-right quadrant bounded by a third segment (226) and a lower-left quadrant bounded by a fourth segment (228). The first segment (222) and fourth segment (228) are each defined by a fourth degree polynomial equation of the general form: $(DX^2+CY^2+A^2)^2-4A^2X^2=B^4$, both segments being defined using the same set of constants (A, B, C and D). The second segment (224) and third segment (226) are each defined by an equation of the general form: $X^2+Y^2=R^2$ (where R is a constant representing the radius of a circle). Poly-circle shape (220) thus is asymmetric about the y-axis, and is symmetric about the x-axis.

The poly-quarter-poly shape (230) includes an upper-left quadrant bounded by a first segment (232), an upper-right quadrant bounded by a second segment (234), a lower-right quadrant bounded by a third segment (236) and a lower-left quadrant bounded by a fourth segment (238), each segment being defined by a fourth degree polynomial equation of the general form: $(DX^2+CY^2+A^2)^2-4A^2X^2=B^4$. The first segment (232), second segment (234) and a fourth segment (238) are each defined using the same first set of constants ($A_1$, $B_1$, $C_1$ and $D_1$). The third segment (236) is defined using a second set of constants $A_2$, $B_2$, $C_2$ and $D_2$, different than the first set of constants. Poly-quarter-poly shape (230) thus is asymmetric about both the x-axis and the y-axis.

The quad-poly shape (240) includes an upper-left quadrant bounded by a first segment (242), an upper-right quadrant bounded by a second segment (244), a lower-right quadrant bounded by a third segment (246) and a lower-left quadrant bounded by a fourth segment (248), each segment being defined by a fourth degree polynomial equation of the general form: $(DX^2+CY^2+A^2)^2-4A^2X^2=B^4$. However, each of the four segments is defined using a different set of constants. Accordingly, quad-poly shape (240) is asymmetric about both the x-axis and the y-axis. Stated differently, the first, second, third and fourth quadrants each have a different non-mirror-image shape.

The poly-quarter-circle shape (250) includes an upper-left quadrant bounded by a first segment (252), an upper-right quadrant bounded by a second segment (254), a lower-right quadrant bounded by a third segment (256) and a lower-left quadrant bounded by a fourth segment (258). The first segment, second segment and fourth segment are each defined by a fourth degree polynomial equation of the general form: $(DX^2+CY^2+A^2)^2-4A^2X^2=B^4$, where A, B, C and D are constants. The third segment (256) is defined by an equation of the general form: $X^2+Y^2=R^2$ (where R is a constant representing the radius of a circle). Accordingly, poly-quarter-circle shape (250) is asymmetric about both the x-axis and the y-axis.

Other noncircular nozzle shapes may be employed, including shapes defined by more than two, three, four, five or more segments. Also, nozzles with segments defined by any number of different equations may be employed, including nozzles with one or more segments defined by polynomial equations.

Figure 3A:
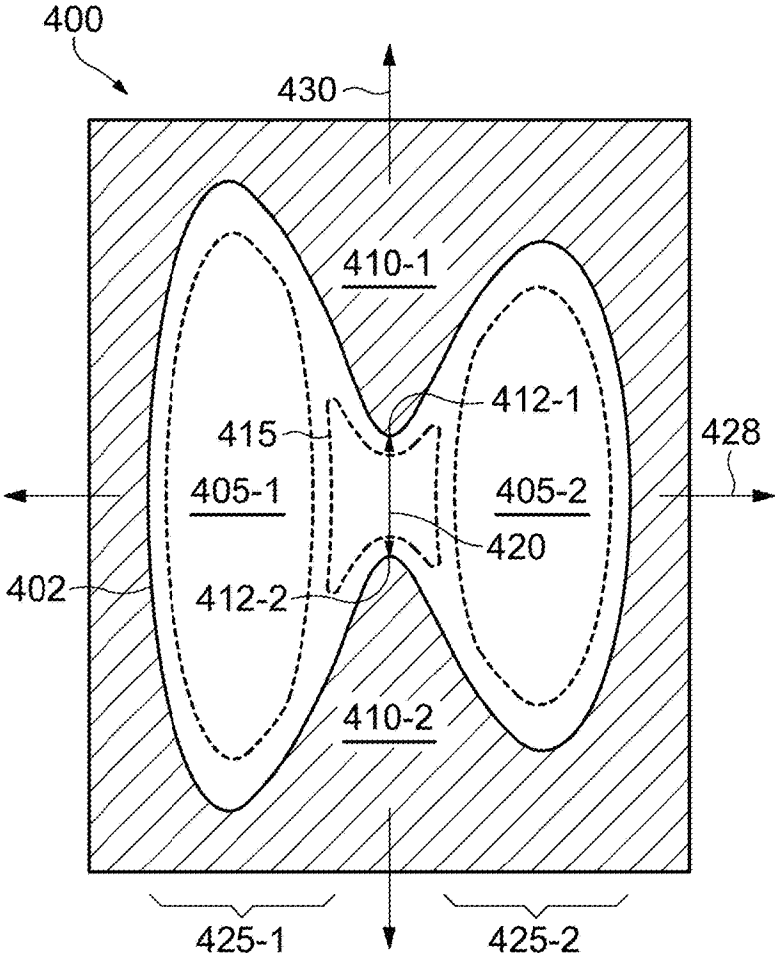
FIG. 3A is a diagram of an illustrative noncircular asymmetric nozzle geometry, according to an embodiment of principles described herein.
Figure 3:
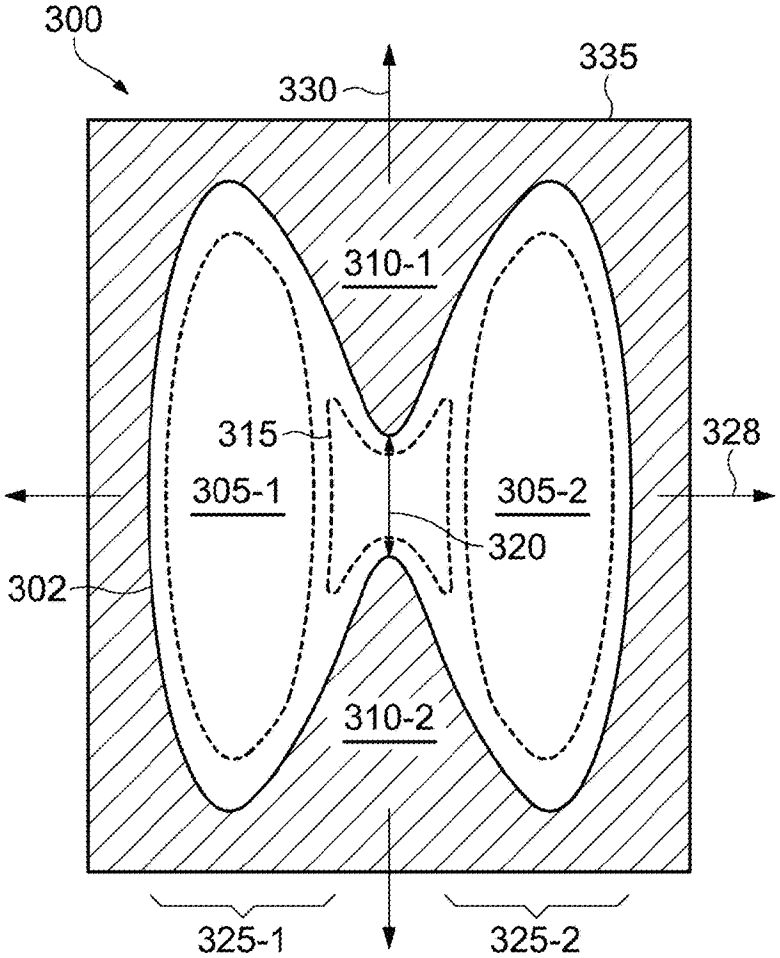
FIG. 3 is a diagram of illustrative noncircular nozzle geometry, according to an embodiment of principles described herein.

FIG. 3 is an illustrative diagram showing a poly-ellipse nozzle (300). According to this illustrative example, the shape of the poly-ellipse aperture (302) is defined by a single fourth degree polynomial equation: $(DX^2+CY^2+A^2)^2-4A^2X^2=B^4$, where A, B, C and D are a first set of constants. This multivariable polynomial generates a closed shape which has a mathematically smooth and mathematically continuous outline. As used in the specification and appended claims, the term "mathematically smooth" refers to a class of functions which have derivatives of all applicable orders. The term "mathematically continuous" refers to a function in which small changes in the input result in small changes in the output. The term "closed" refers to functions which circumscribe an area of a plane or other graphing space such that a path from the interior of the enclosed area to the exterior must cross a boundary defined by the function.

The aperture shape shown in FIG. 3 is generated by a single equation. Specifically, the aperture shape shown in FIG. 3 is not created by joining segments generated by disparate equations in a piecewise fashion. Nozzle apertures with relatively smooth profiles are more efficient in allowing fluid to pass out of the firing chamber.

To generate a shape which is similar to that shown in FIG. 3, the following constants can be substituted into Equation 1 above.

TABLE 1

| | |
|---|---|
| A | 12.3000 |
| B | 12.5345 |
| C | 0.16200 |
| D | 1.38600 |

This poly-ellipse shape defines a noncircular aperture (302) which is used in the nozzle (300). The noncircular aperture (302) has two elliptical lobes (325-1, 325-2). Between the elliptical lobes (325), two protrusions (310-1, 310-2) extend toward the center of the nozzle (300) and create a constricted throat (320). A measurement across the narrowest portion of the throat is called the "pinch" of the throat.

The resistance to fluid flow is proportional to the cross-sectional area of a given portion of the nozzle. Parts of the nozzle which have smaller cross sections have higher resistance to fluid flow. The protrusions (310) create an area of relatively high fluid resistance (315) in the center portion of the aperture (302). Conversely, the lobes (325-1, 325-2) have much larger cross-sections and define regions of lower fluid resistance (305-1, 305-2).

A major axis (328) and a minor axis (330) of the aperture (302) are illustrated as arrows which pass through the poly-ellipse nozzle (300). The major axis (328) bisects the elliptical lobes (325), defining upper and lower halves of the aperture. The minor axis (330) bisects the protrusions (310) and passes across the throat region (320) of the aperture (302), defining left and right halves of the aperture.

An envelope (335) of the aperture (302) is illustrated by a rectangle which bounds the aperture (302) on both the major and minor axes (328, 330). According to one illustrative example, the envelope (335) of the aperture (302) may be approximately 20 microns by 20 microns. This relatively compact size allows the nozzle (300) to be used in printhead configurations which have approximately 1200 nozzles per linear inch.

FIG. 3A is an illustrative diagram showing an asymmetric nozzle (400). In the illustrative example, the poly-poly shape of the aperture (402) is defined by a set of equations, each being of the same general form employed to define the poly-ellipse shape shown in FIG. 3.

In the present example, a first equation may be used to define a first segment of the aperture perimeter, and a second equation may be employed to define a second segment of the aperture perimeter. The equations may be similar, or different, but are selected to collectively generate a closed shape which has a mathematically smooth and mathematically continuous outline.

In FIG. 3A, each equation defines a segment of the aperture perimeter corresponding to one of a pair of opposed aperture lobes (425-1, 425-2). More particularly, a first lobe (425-1) is defined by a first equation having the form: $(D_1X^2+C_1Y^2+A_1^2)^2-4A_1^2X^2=B_1^4$, where $A_1$, $B_1$, $C_1$ and $D_1$ are a first set of constants. Similarly, a second lobe (425-2) is defined by a second equation having the form: $(D_2X^2+C_2Y^2+A_2^2)^2-4A_2^2X^2=B_2^4$, where $A_2$, $B_2$, $C_2$ and $D_2$ are a second set of constants, different from the first set of constants. The first set of constants and second set of constants may be selected to each define common points (412-1, 412-2) in a throat region (420) of the aperture (402). This results in a continuous aperture having elliptical lobes of different shape and/or size. As indicated, the resulting aperture is asymmetric about a minor axis (430), bisects the aperture between the lobes (425-1, 425-2).

To generate a shape which is similar to that shown in FIG. 3A, the following constants can be used:

TABLE 2

| | First Equation | | Second Equation |
|---|---|---|---|
| $A_1$ | 12.3000 | $A_2$ | 12.3000 |
| $B_1$ | 12.3096 | $B_2$ | 12.3152 |
| $C_1$ | 0.0593 | $C_2$ | 0.0935 |
| $D_1$ | 1.5170 | $D_2$ | 1.5183 |

The above equations define an asymmetric noncircular aperture (402) having protrusions (410-1, 410-2) which define a constricted throat (420) having a pinch of 6 um. As indicated, two protrusions (410-1, 410-2) extend toward the center of the nozzle (400) from between two elliptical lobes (425-1, 425-2). The protrusions (410) create an area of relatively high fluid resistance (415) in the center portion of the aperture (402). Conversely, the lobes (425-1, 425-2) have much larger cross-sections and define regions of lower fluid resistance (405-1, 405-2). The first lobe (425-1), however, has a larger cross-sectional area than the second lobe (425-2), and thus would have lower fluid resistance than the second lobe.

A major axis (428) and a minor axis (430) of the aperture (402) are illustrated as arrows which pass through the nozzle (400). The major axis (428) bisects the elliptical lobes (425). The minor axis (430) bisects the protrusions (410) and passes across the throat (420) of the aperture (402).

Although the example of FIG. 3A depicts an asymmetric aperture wherein the first and second equations define first and second lobes, respectively, it is to be understood that the first and second equations may define segments which do not correspond to lobes of the aperture. For example, the first equation may be employed to define a segment of the aperture perimeter that is on one side of the major axis, and the second equation may be employed to define a segment of the aperture perimeter that is on the other side of the major axis. Similarly, the first equation may be employed to define segments corresponding to one or more quadrants of the aperture perimeter, and the second equation may be employed to define the remaining quadrants of the aperture perimeter. In each example, the first set of constants and second set of constants are selected to each define common points along the aperture perimeter so as to maintain a mathematically smooth and mathematically continuous perimeter outline.

Two or more different form equations also may be used to generate a mathematically continuous perimeter outline. For example, as noted previously, the poly-circle shape shown in FIG. 2 includes a first segment defined by a first equation having the general form $(DX^2+CY^2+A^2)^2-4A^2X^2=B^4$ (wherein A, B, C and D are a first set of constants), and a second segment defined by a second equation having the general form $X^2+Y^2=R^2$ (wherein R is a constant representing the radius of a circle). The first set of constants and the radius R may be selected to each define common points along a minor axis of the aperture so as to provide a continuous perimeter of the aperture.

To generate a shape which is similar to that shown in FIG. 2, the following constants can be used:

TABLE 3

| | First Equation | | Second Equation |
|---|---|---|---|
| A | 12.3000 | R | 8.0000 |
| B | 12.3096 | | |
| C | 0.0593 | | |
| D | 1.5170 | | |

Figure 4A:
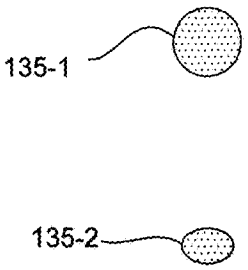
FIGS. 4A-4H is a diagram of illustrative droplet generators ejecting droplets through noncircular nozzles, according to an embodiment of principles described herein.
Figure 4A:
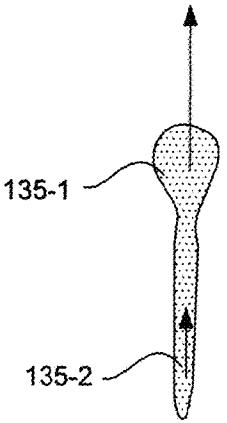
Figure 4A:
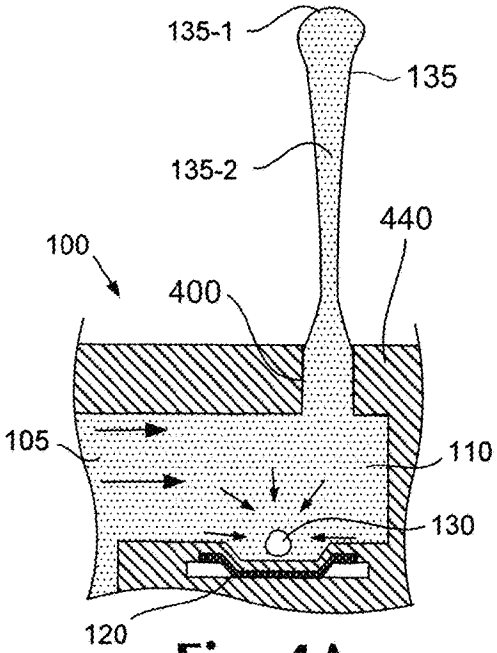
Figure 4B:
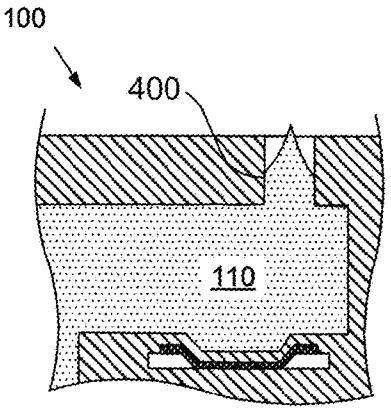
Figure 4C:
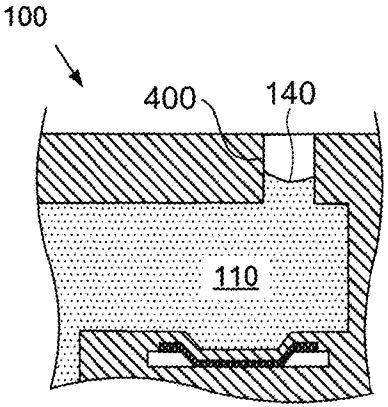

FIGS. 4A-4C depict ejection of a fluid droplet (135) from a droplet generator (100) which includes an asymmetrical noncircular nozzle (400). As shown in FIG. 4A, the droplet generator (100) includes a firing chamber (110) which is fluidically connected to a fluid reservoir (105). A nozzle (400) forms a noncircular asymmetrical passage through the top hat layer (440). A heating resistor (120) creates a vapor bubble (130) which rapidly expands to push a droplet (135) out of the firing chamber (110) and through the nozzle (400) to the exterior. As discussed above, higher volumes and velocities of fluid emerge from the more open portions of the aperture (402). Consequently, the droplet (135) emerges more quickly from the lobes (425-1, 425-2; FIG. 3A) than it does from the throat (420; FIG. 3A).

Because flow through the throat region is slower than through the adjacent lobes, the tail of the droplet (135-2) generally can be automatically and repeatably centered in the vicinity of the throat (320). Although the cross-sectional areas of the first and second lobes (425-1, 425-2; FIG. 3A) also differ, the difference is relatively small in comparison to the difference between the lobes and the throat (420; FIG. 3A). Nevertheless, the size and/or shape of the first and second lobes can be selected to further refine the position of the tail of the droplet (135-2).

There are several advantages of having the tail of the droplet (135-2) centered at the throat (420). For example, centering the tail (135-2) over the throat (420) may provide a more repeatable separation of the tail (135) from the body of liquid which remains in the firing chamber (110, FIG. 1). This will keep the tail (135-2) aligned with head of the droplet (135-1) and improve the directionality of the droplet (135).

Another advantage of centering the tail (135-2) over the throat (420) is that as the vapor bubble collapses, the higher fluid resistance of throat (420) reduces the velocity difference in the tail (135-2). This can prevent the droplet (135) from being violently torn apart as the front portion of the droplet (135-1) continues to travel at approximately 10 m/s away from the nozzle (400) and a portion of the tail (135-2) is pulled back inside the firing chamber (110). Instead, surface tension forms an ink bridge across the pinch. This ink bridge supports the tail (135-2) while the ink is being pulled back into the bore during the collapse of the vapor bubble. The fluid is drawn in from lobes (425), forming a meniscus (140) which continues to be drawn into the firing chamber (110).

As the vapor bubble (130) collapses, fluid is drawn into the firing chamber (110) from both the inlet of the fluid reservoir (105) and the nozzle (400). However, as illustrated in FIG. 4B, the centering of the tail (135-2) over the throat and the velocity differences within the droplet (135) reduces the likelihood that sub-droplets (135-3, FIG. 1E) will be produced. If these relative velocities are similar enough in magnitude and direction, the surface tension forces will draw the tail (135-2) up into the droplet head (135-1). This single droplet (135) will then continue to the substrate and land on or near the target location.

As shown in FIG. 4C, the velocity difference between the droplet head (135-1) and the droplet tail (135-2) may not be sufficiently small to allow the tail (135-2) to coalesce with the head (135-1). Instead, two droplets may be formed: a larger head droplet (135-1) and a smaller tail droplet (135-2).

According to one illustrative example, the droplet generator and its nozzle can be designed to repeatably produce droplets with a mass in a desired range. Such desired range generally will fall within the broader range of 1.5 nanograms to 30 nanograms. In one example, droplets are formed with a target mass of 6 nanograms. In a second example, droplets are formed with a target mass of 9 nanograms. In a third example, droplets are formed with a target mass of 12 nanograms.

FIGS. 4D-4H focus in more detail on the vapor bubble collapse, the tail separation, and the retraction of the meniscus into the firing chamber. In FIGS. 4D-4H, the dotted lines represent the interior surfaces of the droplet generator (100). The textured shapes represent liquid/vapor interfaces.

Figure 4D:
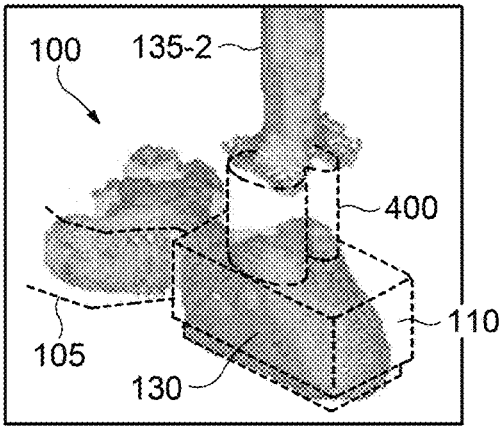
Figure 4E:
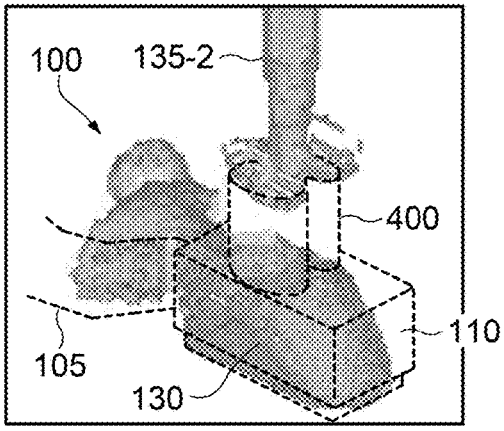

FIG. 4D shows the vapor bubble (130) near its maximum size. The vapor bubble (130) fills most of the firing chamber (110). The tail (135-2) of the droplet extends out of the nozzle (400). FIG. 4E shows the vapor bubble (130) beginning to collapse and the tail of the droplet beginning to thin.

Figure 4F:
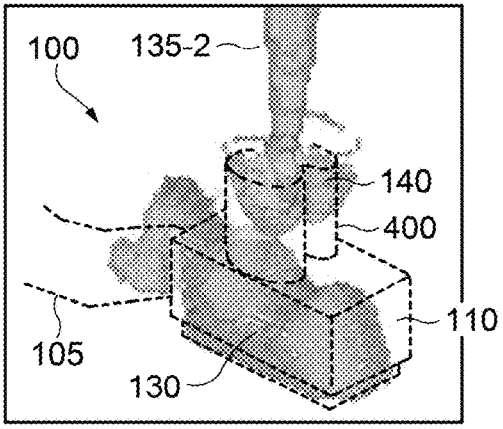

FIG. 4F shows the vapor bubble (130) continuing to collapse and a meniscus (140) beginning to form in the nozzle (400) as the collapsing bubble (130) draws air from the exterior into the nozzle (400). As can be seen in FIG. 4F, the meniscus (140) forms two lobes which correspond to the two lobes of the nozzle (400). The tail (135-2) remains centered over the center of the nozzle (400). As discussed above, position of the tail (135-2) at separation can influence the trajectory of the droplet.

Figure 4G:
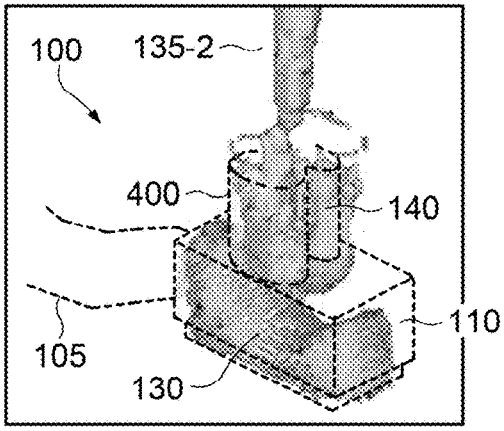

FIG. 4G shows that the vapor bubble (130) has entirely retracted from the ink reservoir (105) and is beginning to divide into two separate bubbles. The meniscus (140) continues to deepen into the firing chamber (110), indicating that air is being drawn into the firing chamber (110). The tail (135-2) is separating from nozzle (400), and is detaching from a neutral position over the center of the nozzle (400).

Figure 4H:
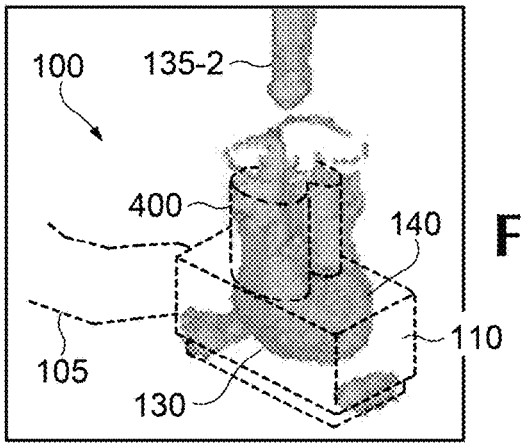

FIG. 4H shows the tail (135-2) has completely separated from the nozzle (400). The surface tension in the tail (135-2) has begun to draw the bottom most portions of the tail up into the main portion of the tail. This results in the tail (135-2) having a slightly bulbous end. The vapor bubble (130) has collapsed into two separate bubbles which are in the corners of the firing chamber (110). As discussed above, there are a reduced number of satellite droplets during the ejection of the droplet from the droplet generator (100) which includes a poly-poly nozzle (400).

Figure 5A:
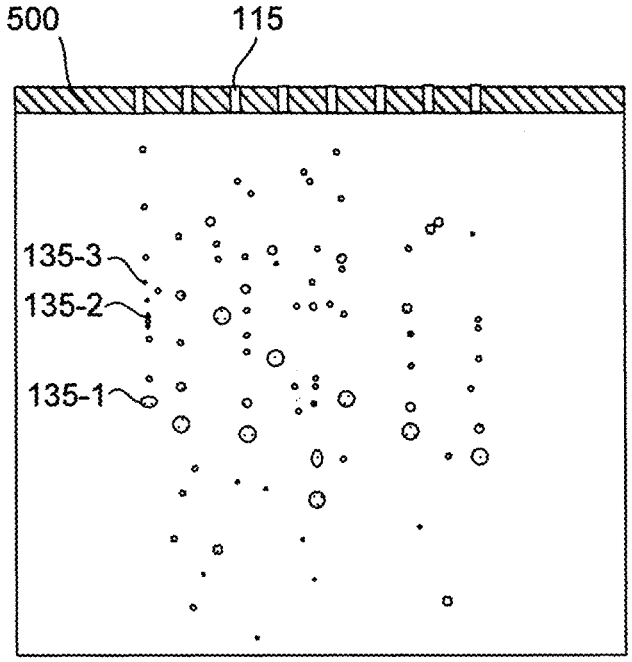
FIGS. 5A and 5B are illustrative diagrams of droplets ejected from circular nozzles and noncircular nozzles, respectively, according to embodiments of principles described herein.
Figure 5B:
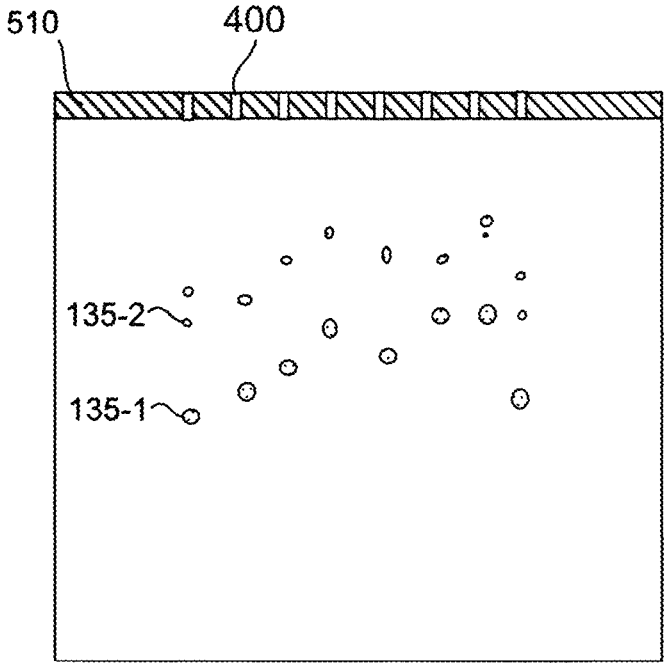

FIGS. 5A and 5B are diagrams which illustrate actual images of the ejection of ink droplets from an array of circular nozzles, as shown in FIGS. 1A-1F, and ink droplets which are ejected from an array of poly-poly nozzles, as shown in FIGS. 4A-4F.

As can be seen in FIG. 5A, the droplets ejected from the circular nozzles (115) in a printhead (500) are shattered into numerous different sub-droplets (135-3). This creates a mist of droplets (135) of various sizes. As discussed above, sub-droplets (135-3) with lower masses lose velocity quickly and can remain airborne for long periods of time.

FIG. 5B is a diagram of the ejection of droplets (135) from poly-poly nozzles (400) in a printhead (510). In this case, the droplets (135) have consistently formed only head droplets (135-1) and tail droplets (135-2). There is little evidence of smaller sub-droplets. The head droplet (135-1) and the tail droplets (135-2) may merge in flight and/or may impact the same area of the substrate.

Figure 6A:
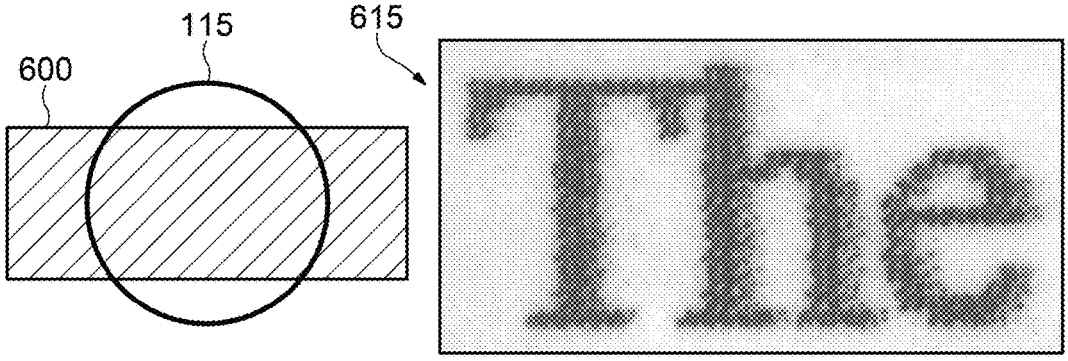
FIGS. 6A and 6B are illustrative diagrams of images created by an inkjet printhead with circular nozzles and an inkjet printhead with noncircular nozzles, respectively, according to embodiments of principles described herein.
Figure 6B:
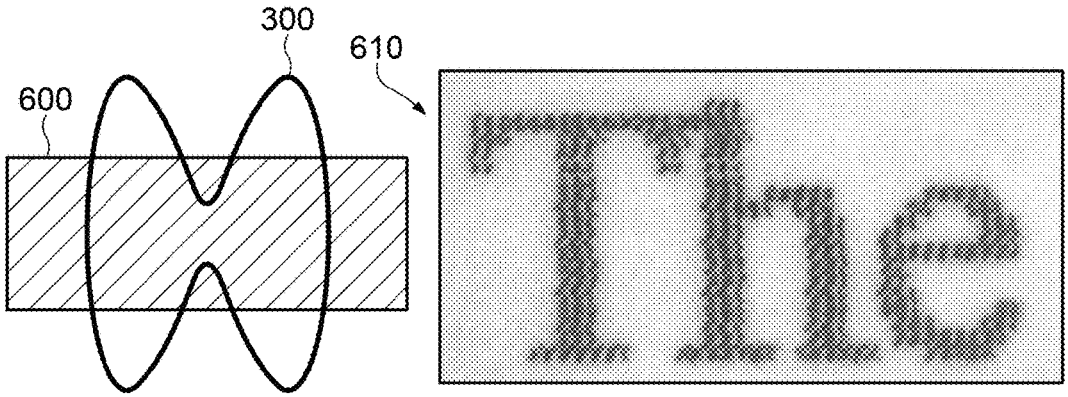

FIGS. 6A and 6B are illustrative diagrams which contrast the print quality effects of circular nozzles and noncircular nozzles. The left hand side of the FIG. 6A illustrates the circular nozzle (115) and the relative orientation and size of the underlying heating resistor (600). The right hand side of the FIG. 6A is a photograph (615) showing a section of text produced using the circular nozzles. The text is the word "The" in four point font. Clearly visible in the photograph (615) is the blurring of the text edges produced by medium mass sub-droplets with a slower velocity. These sub-droplets do not impact in the desired locations and cause blurring of the image. As discussed above, the lowest mass sub-droplets may not ever contact the substrate.

The left hand side of FIG. 6B shows a noncircular nozzle (300) overlying the heating resistor (600). As shown in the right hand photograph (610), the same word in the same font is shown as it would appear if printed using a noncircular nozzle design. The print quality produced by the noncircular nozzle is significantly better with respect to edge crispness than the circular nozzle (115). Clearly absent are the relatively small dots which indicate droplet breakup.

Another result of larger droplet sizes is that the droplets are placed with greater accuracy. The interior of the letters of the word "The" show a significant amount of light/dark texture or "graininess" in the interior of the letters. This is a result of larger droplet sizes which travel more accurately to a target location. For example, if each ejection cycle results in two drops, the head droplet and the tail droplet may both land in the same location. This can result in white space between the target locations.

A variety of parameters could be selected or altered or to optimize the performance of a nozzle (300), including the shape of the nozzle. For example, an asymmetric nozzle may impact refill frequency and/or tail separation upon bubble collapse. In addition to the shape of the nozzle, the characteristics of the ink can affect the performance of the nozzle. For example, the viscosity, surface tension, and composition of the ink can affect the nozzle performance.

Figure 7A:
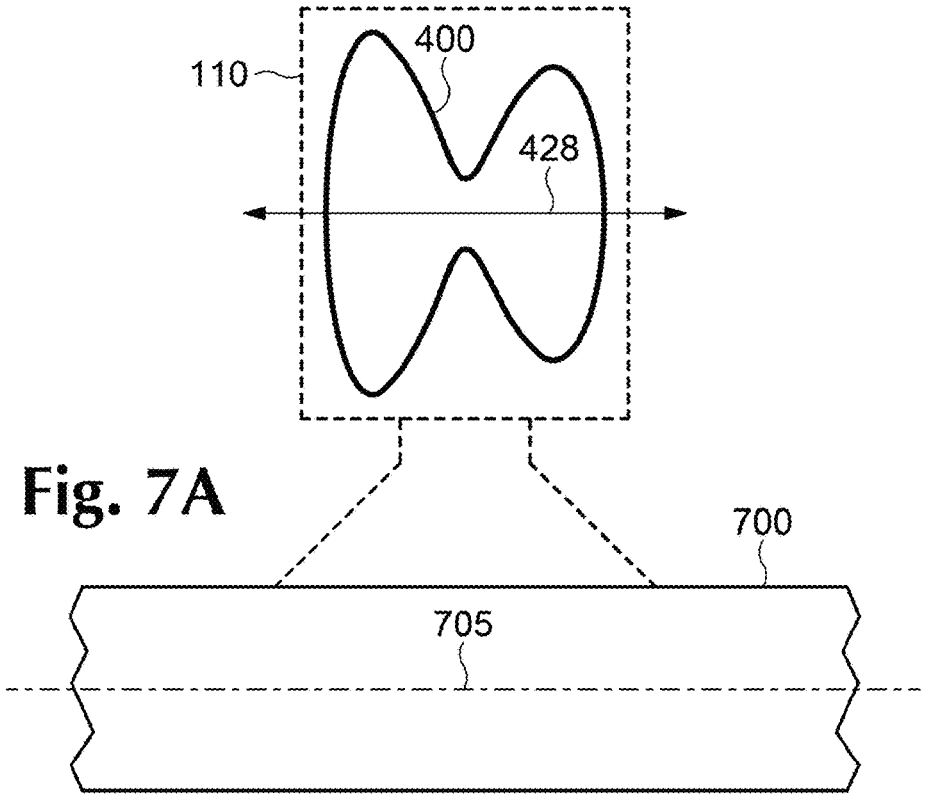
FIGS. 7A and 7B are illustrative diagrams of a circular inkjet nozzle and a noncircular inkjet nozzle with underlying resistors, according to embodiments of principles described herein.
Figure 7B:
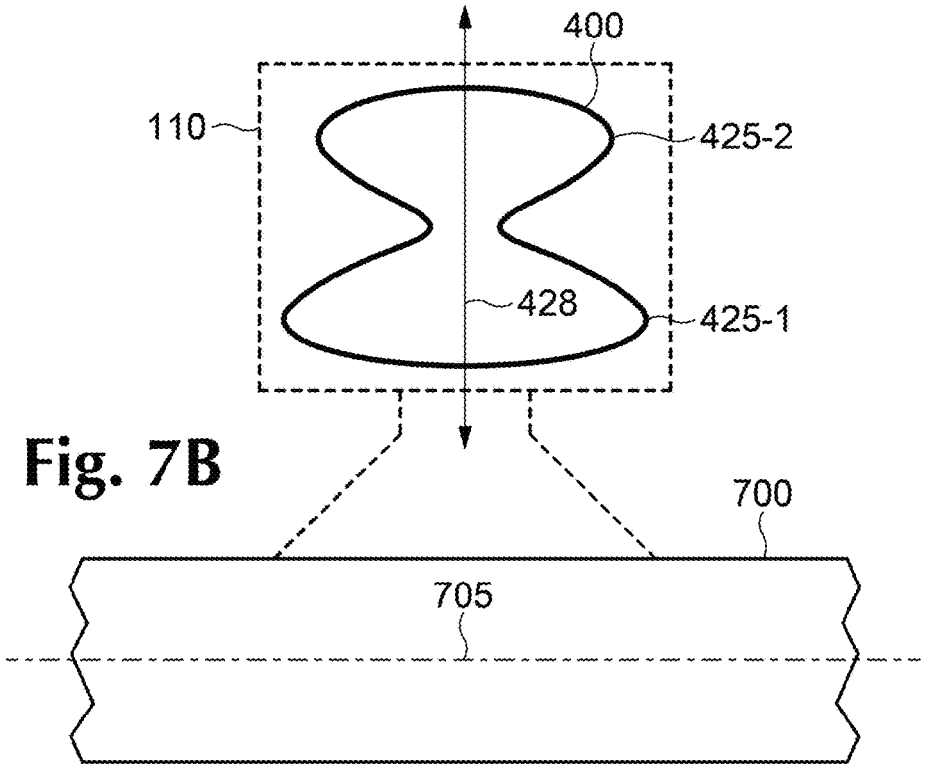

FIGS. 7A and 7B illustrate one parameter which can be adjusted to alter the performance of the nozzle. Specifically, the orientation of a feed slot (700) with respect to the nozzle (400) can be adjusted. The feed slot (700) is an aperture which forms a fluidic connection between a primary ink reservoir and a plurality of firing chambers (110) which are arranged along the sides of the feed slot (700). According to one illustrative embodiment shown in FIG. 7A, the major axis (428) of the nozzle (400) is parallel to the major axis (705) of the feed slot (700). In this example, the centers of both of the lobes of the poly-poly nozzle (400) are equally distant from the feed slot (700) and exhibit approximately the same behavior.

FIG. 7B shows the major axis (705) of the feed slot (700) and major axis (428) of the nozzle (400) in a perpendicular orientation. In this configuration, one of the lobes is located at a different distance from the feed slot (700) than the other lobe. This orientation may result in increased fluidic refill speed of the firing chamber, but also may cause an asymmetric fluid behavior in the two lobes. In particular, during collapse of the vapor bubble after firing, a meniscus may form differently in each lobe of the nozzles. Such differential meniscus retraction may result in increased dot placement error.

Differential meniscus retraction may be addressed by adjustment of the nozzle geometry. In particular, an asymmetric nozzle (400) may be employed, and configured so as to compensate for differential meniscus retraction. In the depicted example, asymmetric nozzle (400) may be configured with a larger lobe (425-1) closer to feed slot (700) and a smaller lobe (425-2) more distant from feed slot (700).

Figure 8:
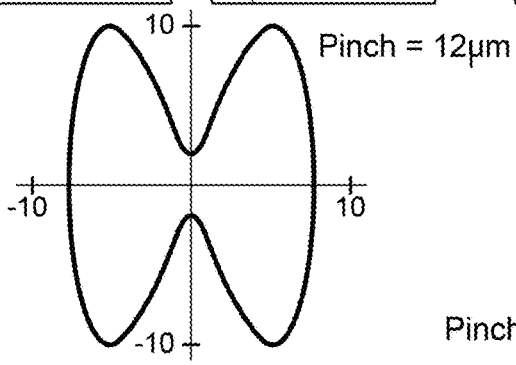
FIG. 8 includes diagrams of a number of illustrative aperture geometries, according to embodiments of principles described herein.
Figure 8:
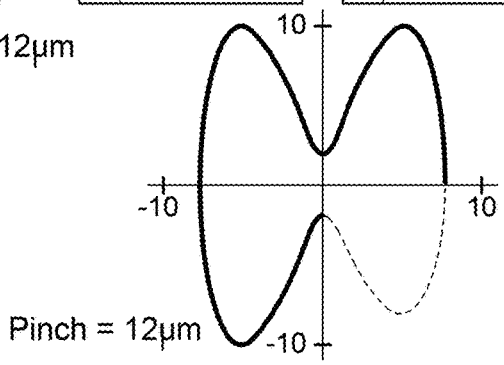
Figure 8:
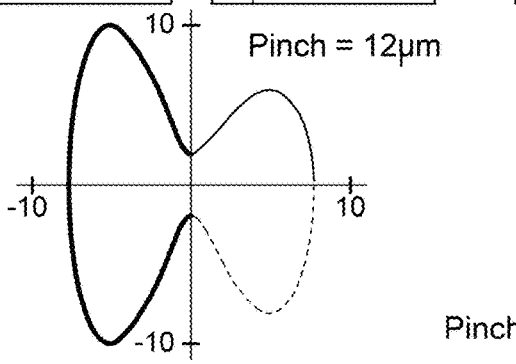
Figure 8:
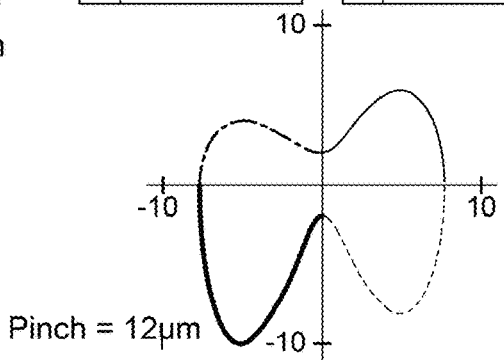

As noted above, the size and shape of the lobes of the nozzle can influence the geometry of the vapor bubble during a firing sequence. FIG. 8 includes a number of illustrative poly-poly nozzle profiles which could be created by independently selecting the parameters of the polynomial equation $(DX^2+CY^2+A^2)^2-4A^2X^2=B^4$ for each quadrant of the perimeter. Each illustrative example in FIG. 8 includes a profile with the pinch of the throat and a chart listing the parameters (A, B, C and D) used to generate the geometry. The profile is superimposed on a graph which shows −x and −y distances in microns.

These constants may be selected from a range of values to create the desired shape. For example, A may have a range of approximately 6 to 14; B may have a range of approximately 6 to 14; C may have a range of approximately 0.001 to 1; and D may have a range of approximately 0.5 to 2. In one example, where a segment of the aperture is to correspond to a poly-ellipse configured to produce drops having a drop weight on the order of 30 nanograms, A may be 12.3000, B may be 12.5887, C may be 0.1463 and D may be 1.0707. In another example, where a segment of the aperture is to correspond to a poly-ellipse configured to produce drops having a drop weight on the order of 1.5 nanograms, A may be 6.4763, B may be 6.5058, C may be 0.0956 and D may be 1.5908.

The constants may be selected such that the resulting nozzle defined by the polynomial produces droplets with a desired drop mass. For example, the pinch may range from 3 and 14 microns and the drop mass may range from 1.5 nanograms to 30 nanograms. As discussed above, a variety of constant values may be selected to generate the desired geometry. Additionally, a number of other equations could be used to generate noncircular forms.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A fluid nozzle comprising:
an aperture comprising:
a first lobe that is shaped as an ellipse, and
a second lobe that has a noncircular shape and has a different size than a size of the first lobe; and
protrusions between the first and second lobes extending inward and forming a throat between the first and second lobes,
wherein the aperture has a minor axis that bisects the protrusions, the aperture being asymmetric about the minor axis.

2. The fluid nozzle of claim 1, wherein the second lobe is shaped as an ellipse.

3. The fluid nozzle of claim 1, wherein the first lobe is on a first side of the minor axis, and the second lobe is on a different second side of the minor axis.

4. The fluid nozzle of claim 1, wherein the aperture has a shape that is mathematically continuous and mathematically smooth.

5. A fluid nozzle comprising:
an aperture comprising:
a first lobe that is shaped as an ellipse, and
a second lobe that has a noncircular shape and has a different size than a size of the first lobe, wherein the aperture has a major axis that bisects the first and second lobes, wherein the first lobe has a first segment on a first side of the major axis, and a second segment on a different second side of the major axis, wherein the second lobe has a first segment on the first side of the major axis, and a second segment on the different second side of the major axis, and wherein each of the first and second segments of the first lobe has a shape defined by a first polynomial equation, and each of the first and second segments of the second lobe has a shape defined by a second polynomial equation that is different from the first polynomial equation; and
protrusions between the first and second lobes extending inward and forming a throat between the first and second lobes.

6. The fluid nozzle of claim 5, wherein the first polynomial equation that forms the shape of the first lobe is a fourth degree order polynomial equation, and the second polynomial equation that forms the shape of the second lobe is a fourth degree order polynomial equation.

7. A fluid ejection device comprising:
a droplet generator comprising:
a firing chamber to fluidically couple to a fluid reservoir;
an ejection element; and
a nozzle comprising:
an aperture comprising a first lobe and a second lobe, the aperture forming a passage from the firing chamber to an exterior of the droplet generator, the first lobe being shaped as an ellipse, and the second lobe having a noncircular shape and a size different than a size of the first lobe, and
protrusions between the first and second lobes extending inward and forming a throat between the first and second lobes, wherein the aperture has a minor axis that bisects the protrusions, the aperture being asymmetric about the minor axis.

8. The fluid ejection device of claim 7, wherein first and second lobes are differently spaced from the fluid reservoir, and wherein the first and second lobes are geometrically asymmetric to reduce a difference in meniscus retraction rate between the first lobe and the second lobe.

9. The fluid ejection device of claim 7, wherein the ejection element is to cause ejection of a fluid droplet from the firing chamber through the aperture.

10. The fluid ejection device of claim 9, wherein the ejection element comprises a heating resistor.

11. The fluid ejection device of claim 7, further comprising:

a fluid slot to communicate fluid from the fluid reservoir to the firing chamber, wherein the aperture has a major axis that bisects the first and second lobes, and the fluid slot has a major axis that is parallel to the major axis of the aperture.

12. The fluid ejection device of claim 7, further comprising:

a fluid slot to communicate fluid from the fluid reservoir to the firing chamber, wherein the aperture has a major axis that bisects the first and second lobes, and the fluid slot has a major axis that is perpendicular to the major axis of the aperture.

13. The fluid ejection device of claim 7, wherein the second lobe is shaped as an ellipse.

14. The fluid ejection device of claim 7, wherein the aperture has a shape that is mathematically continuous and mathematically smooth.

15. A fluid ejection device comprising:

a droplet generator comprising:

a firing chamber to fluidically couple to a fluid reservoir;

an ejection element and a nozzle comprising:

an aperture comprising a first lobe and a second lobe, the aperture forming a passage from the firing chamber to an exterior of the droplet generator, the first lobe being shaped as an ellipse, and the second lobe having a noncircular shape and a size different than a size of the first lobe, wherein the first lobe has a shape defined by a first polynomial equation, and the second lobe has a shape defined by a second polynomial equation that is different from the first polynomial equation, and protrusions between the first and second lobes extending inward and forming a throat between the first and second lobes.

16. The fluid ejection device of claim 15, wherein the first polynomial equation that defines the shape of the first lobe is a fourth degree order polynomial equation, and the second polynomial equation that defines the shape of the second lobe is a fourth degree order polynomial equation.

* * * * *